US007485018B2

(12) United States Patent
Wilson et al.

(10) Patent No.: US 7,485,018 B2
(45) Date of Patent: Feb. 3, 2009

(54) MARINE DRIVE SYSTEM

(76) Inventors: Jim Wilson, 810 Pembroke, White Lake, MI (US) 48326; Scott Snow, 3600 Shirley St., Commerce, MI (US) 48390

( * ) Notice: Subject to any disclaimer, the term of this patent is extended or adjusted under 35 U.S.C. 154(b) by 0 days.

(21) Appl. No.: 11/405,204

(22) Filed: Apr. 17, 2006

(65) Prior Publication Data

US 2006/0258233 A1 Nov. 16, 2006

Related U.S. Application Data

(60) Provisional application No. 60/671,812, filed on Apr. 15, 2005, provisional application No. 60/676,328, filed on Apr. 29, 2005.

(51) Int. Cl.
*B63H 5/125* (2006.01)

(52) U.S. Cl. ..... 440/59

(58) Field of Classification Search ..... 440/58–60
See application file for complete search history.

(56) References Cited

U.S. PATENT DOCUMENTS 2,458,813 A * 1/1949 Wanzer ..... 440/59
2,946,306 A * 7/1960 Leipert ..... 440/58

* cited by examiner

*Primary Examiner*—Stephen Avila
(74) *Attorney, Agent, or Firm*—Gifford, Krass, Sprinkle, Anderson, & Citkowski, P.C.

(57) ABSTRACT

A marine drive assembly includes at least one vessel hull having at least one cavity formed therein. At least one drive assembly is disposed in the at least one cavity. The at least one drive assembly includes upper and lower units. The upper unit is pivotally mounted within the hull-cavity for adjusting a pitch of the drive assembly about a vertical axis. The lower unit is coupled to the upper unit and includes a propulsory member for propelling the vessel through a body of water.

18 Claims, 10 Drawing Sheets

MARINE DRIVE SYSTEM

RELATED APPLICATIONS

This application claims priority of U.S. Patent Provisional Applications Nos. 60/671,812 filed Apr. 15, 2005 and 60/676,328 filed Apr. 29, 2005 which are incorporated herein by reference.

FIELD OF THE INVENTION

The invention relates to marine drive systems.

BACKGROUND OF THE INVENTION

Today's drive technologies have either limited or no vertical axis pitch control and/or horizontal axis steering capability. Drives with reasonable pitch and steering authority such as outboards and outdrives are limited to relatively small vessels because of the torque and horsepower restrictions of these drives. These existing drive designs are not practical for large vessels requiring higher output powerplants. There is therefore a need in the art for robust, vertical axis control drive technologies capable of reliably managing greater torque and horsepower along with a wide variety of vessel applications, spanning small, medium and large vessel installations. Equally as important is a need for dynamic horizontal axis authority. If integral to these new drive technologies, this feature would significantly advance vessel maneuverability and performance as defined by present day standards, particularly aboard medium and large vessels which, based on today's steerable drive products, are restricted to comparatively low-speed operations.

Accordingly, as disclosed in the present application and as described in U.S. provisional patents: Ser. Nos. 60/671,812 and 60/676,328, which are herein incorporated by reference, the drive system of the present invention solves the limitations of typical marine drives by providing a drive system that is mounted so to have freedom to articulate within a well or cavity formed in the hull of a vessel allowing its thrust vectors to be pitch and steer manipulated. The drive assemblies can be positioned anywhere in the hull, or hulls in the case of multi-hulled vessels, in order to complement particular vessel design features, performance objectives and/or mission requirements. More traditional placement examples being forward of or forward-adjacent to the transom, as typical of an "inboard" installation, and aft of or aft-adjacent to the transom for adaptation to outboard engines, outdrives and other similar on-transom installations. The drive system disclosed herein may be used with turbine engines, internal combustion engines or other suitable torque-generating means. The novel pitch articulating drive system design described below incorporates steering, powerplant flexibility including the ability to integrate with any quantity of engines, any type or make of engine, in different propulsion package configurations as positioned aboard a vessel. The drive system is also capable of scaling to handle all measure of marine engine power output and is engineered to integrate with a computer based active thrust vector control system, single or multiple-drive vessels, for both pitch (vertical axis), steer (horizontal axis) and differential thrust management. The novel drive system will accommodate various marine vessels, regardless of size and weight, with a robust, comparatively lightweight design that can be either scaled or configured to meet numerous installation requirements. Design elements and components of the described drive technologies, such as its 360 degree steering, can be adapted to existing marine outboard and outdrive products to greatly enhance their overall performance and capability.

SUMMARY OF THE INVENTION

A marine drive assembly includes at least one vessel hull having at least one cavity formed therein. At least one drive assembly is disposed in the at least one cavity. The at least one drive assembly includes upper and lower units. The upper unit is pivotally mounted within the hull-cavity for adjusting a pitch of the drive assembly about a horizontal axis. The lower unit is coupled to the upper unit and includes a propulsory member for propelling the vessel through a body of water.

BRIEF DESCRIPTION OF THE DRAWINGS

SUMMARY OF THE INVENTION

Figure 1:
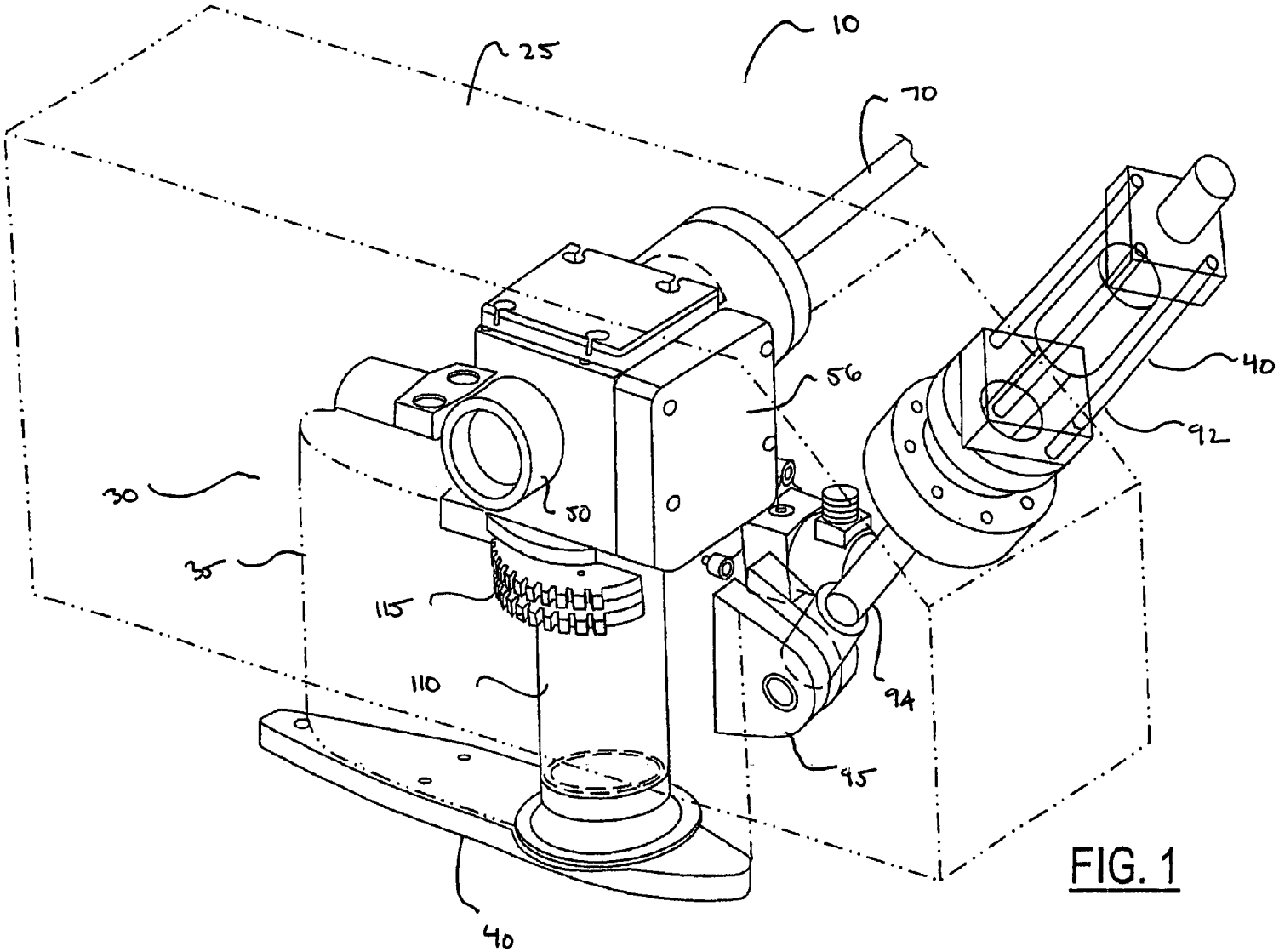
Figure 2:
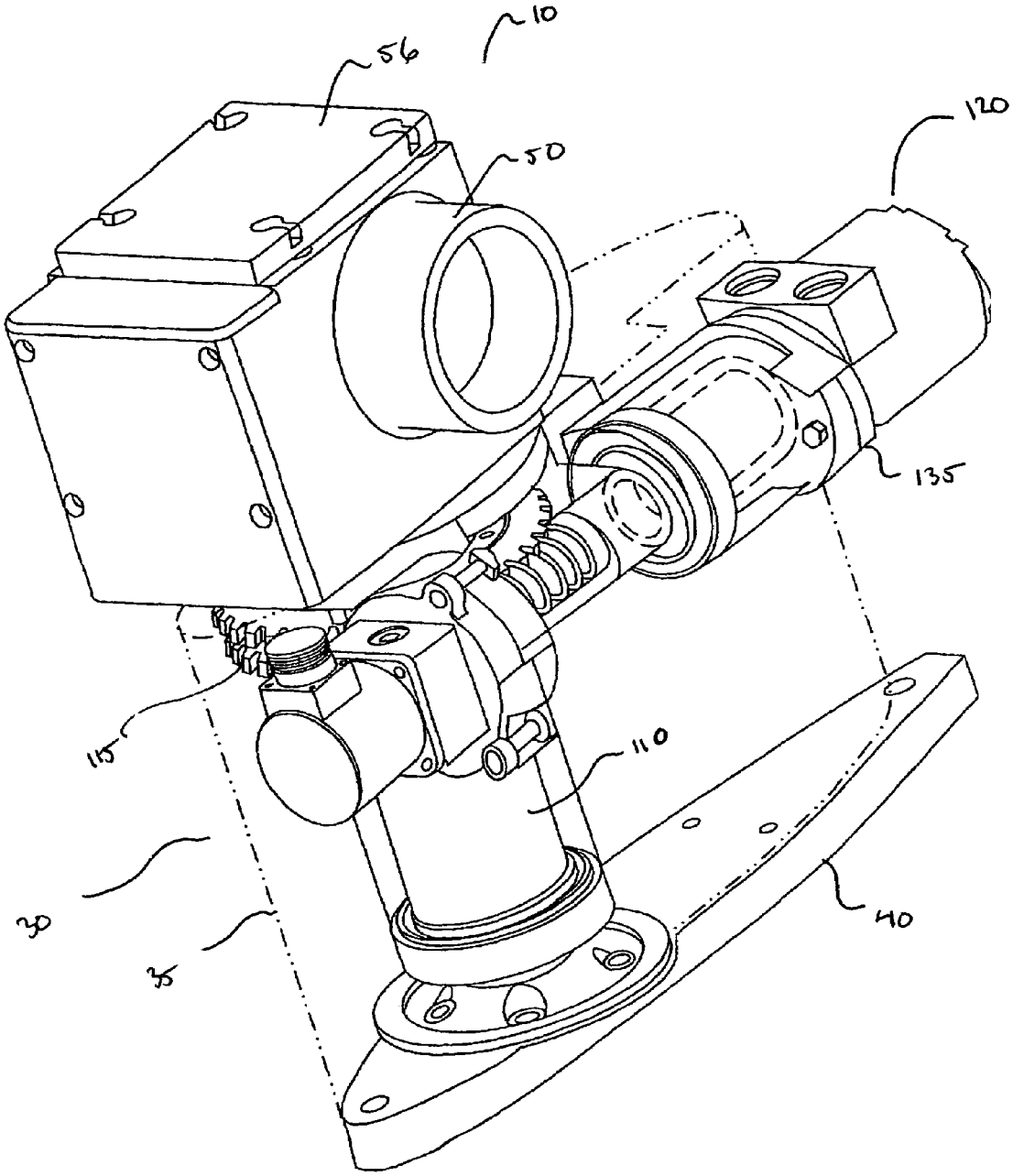
Figure 3:
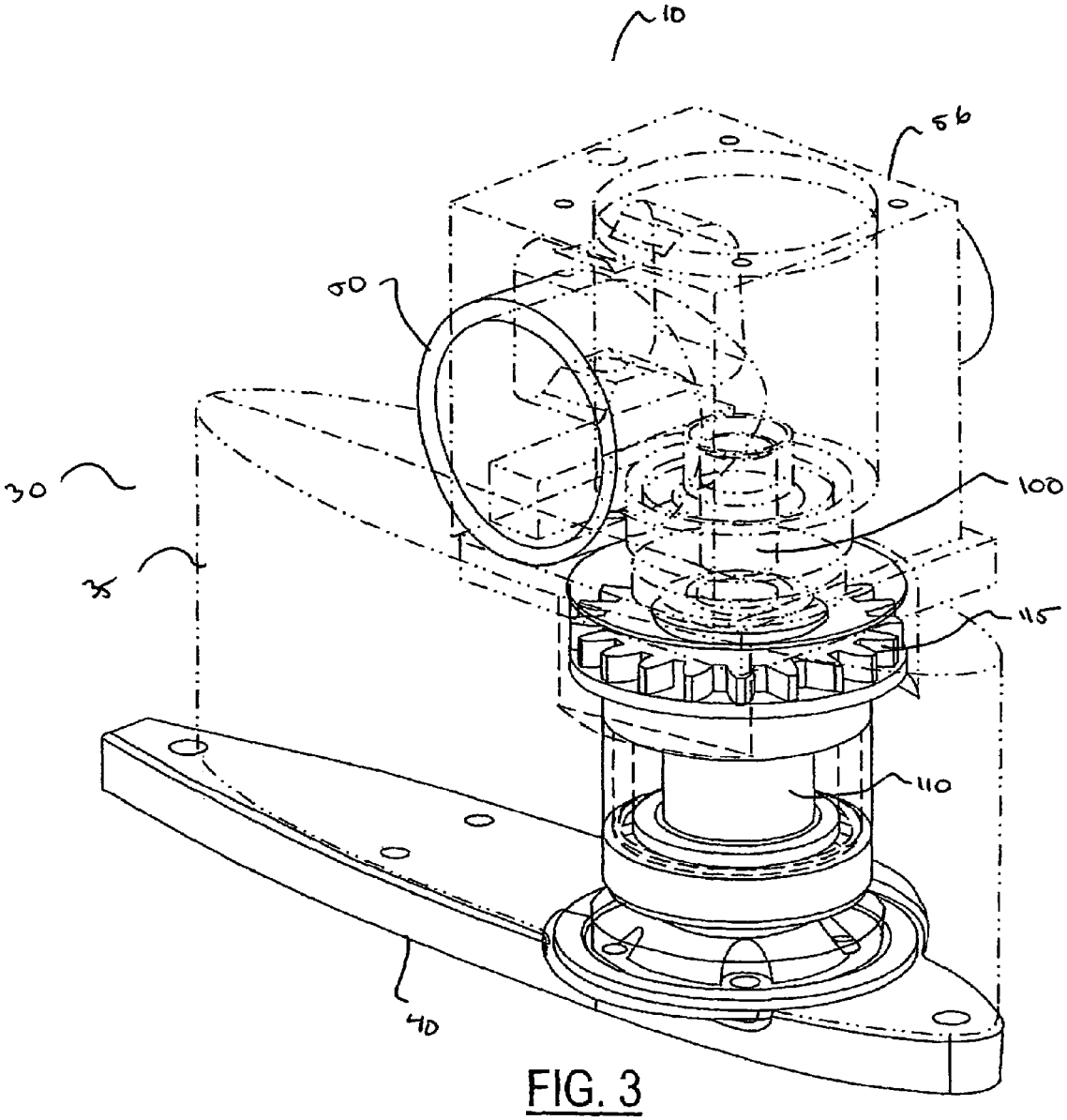
Figure 4:
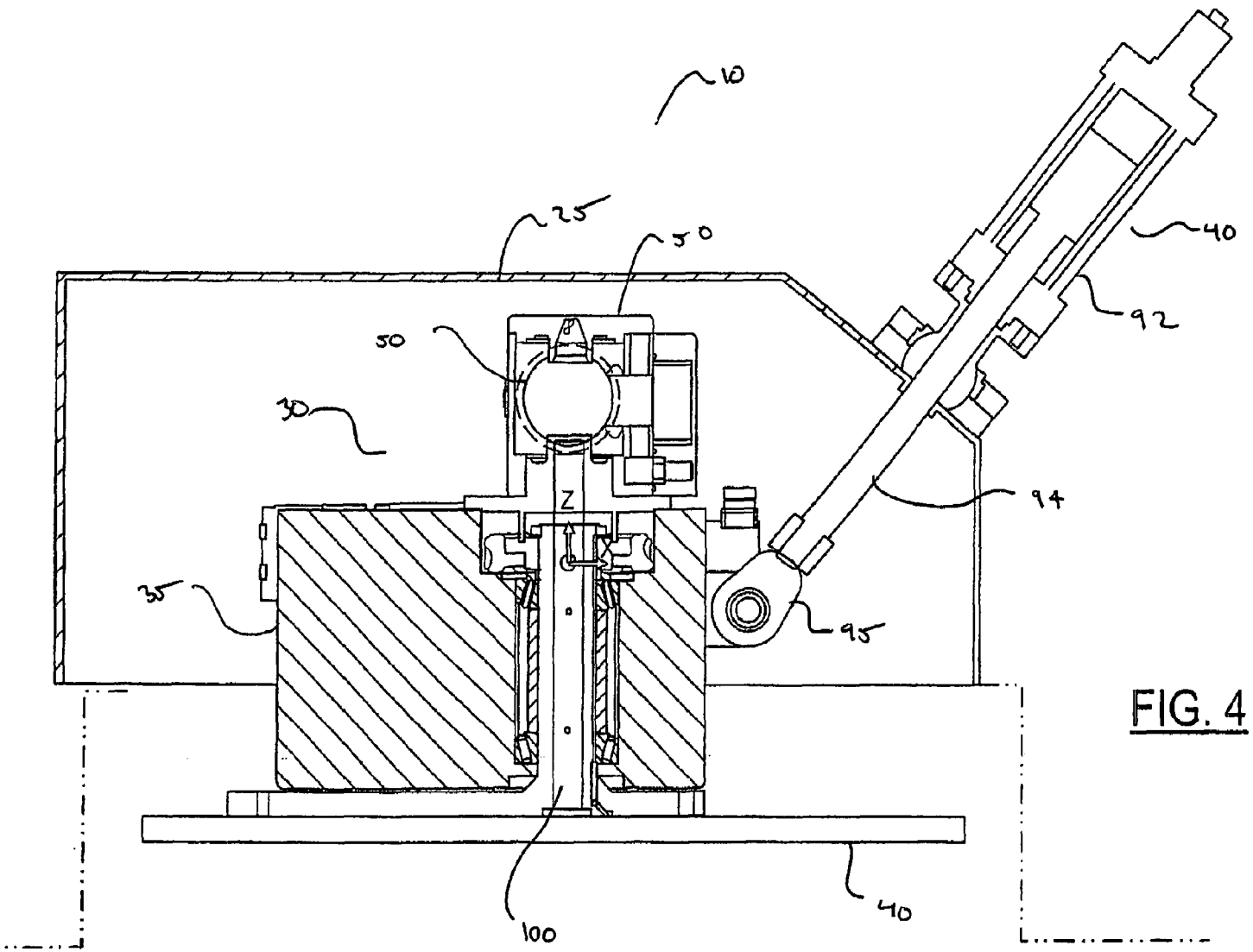
Figure 5:
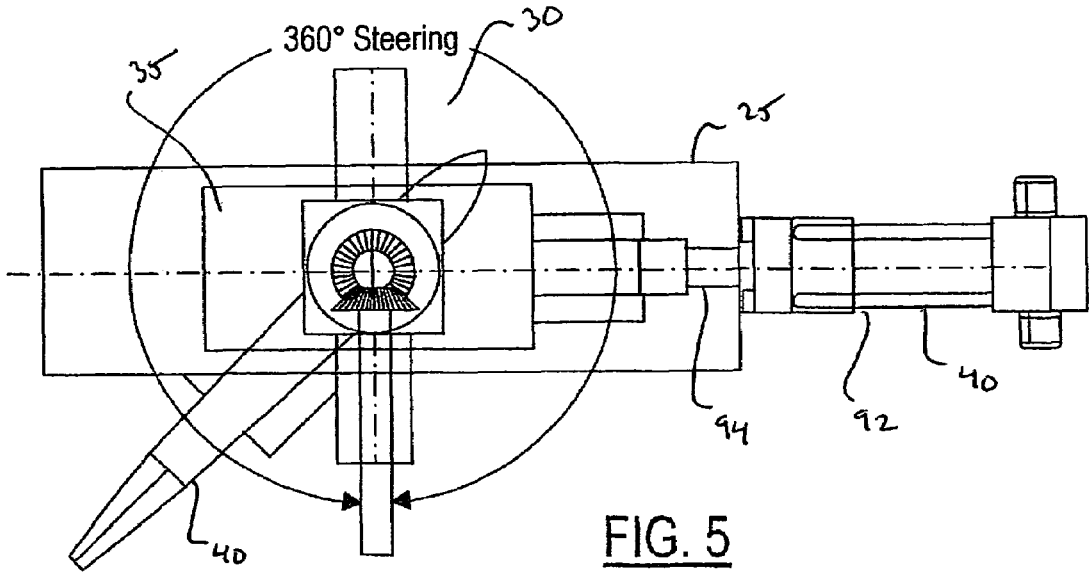
Figure 6:
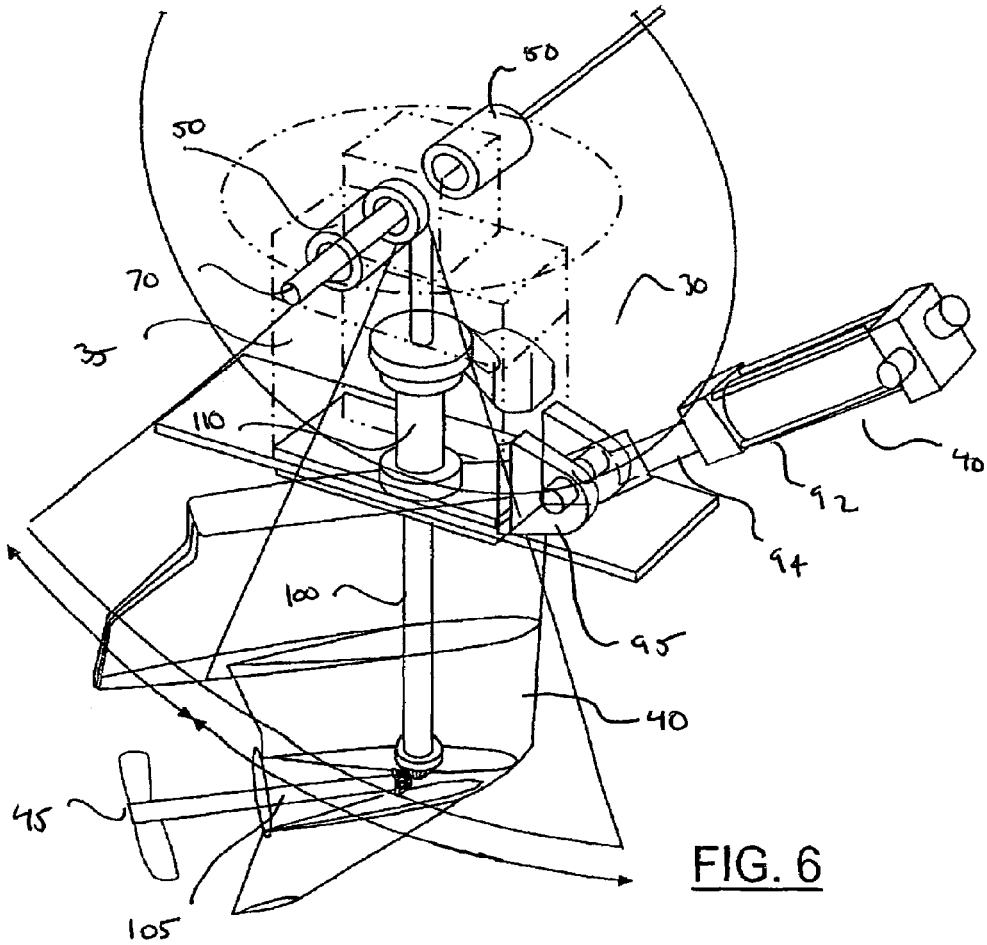
Figure 7:
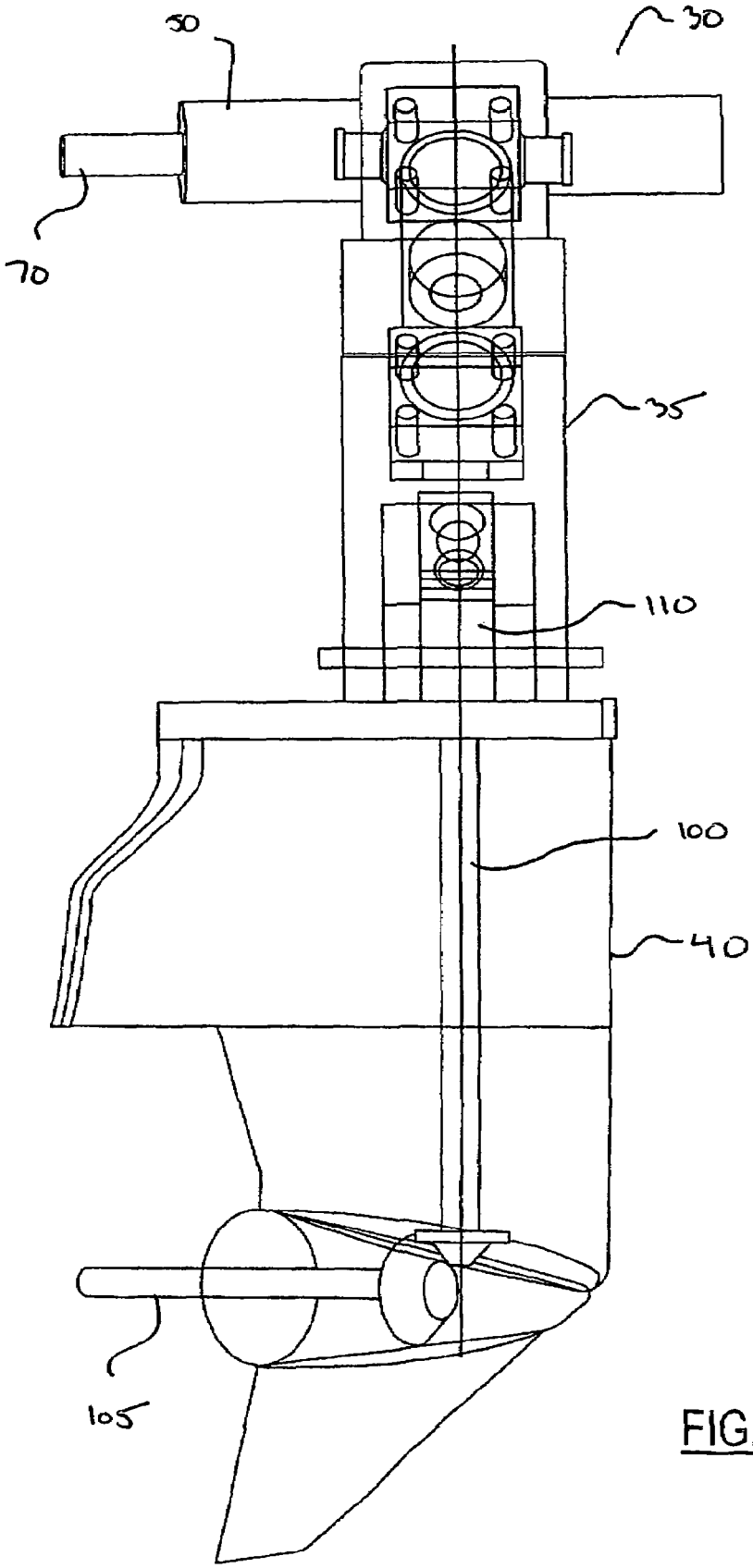
Figure 8:
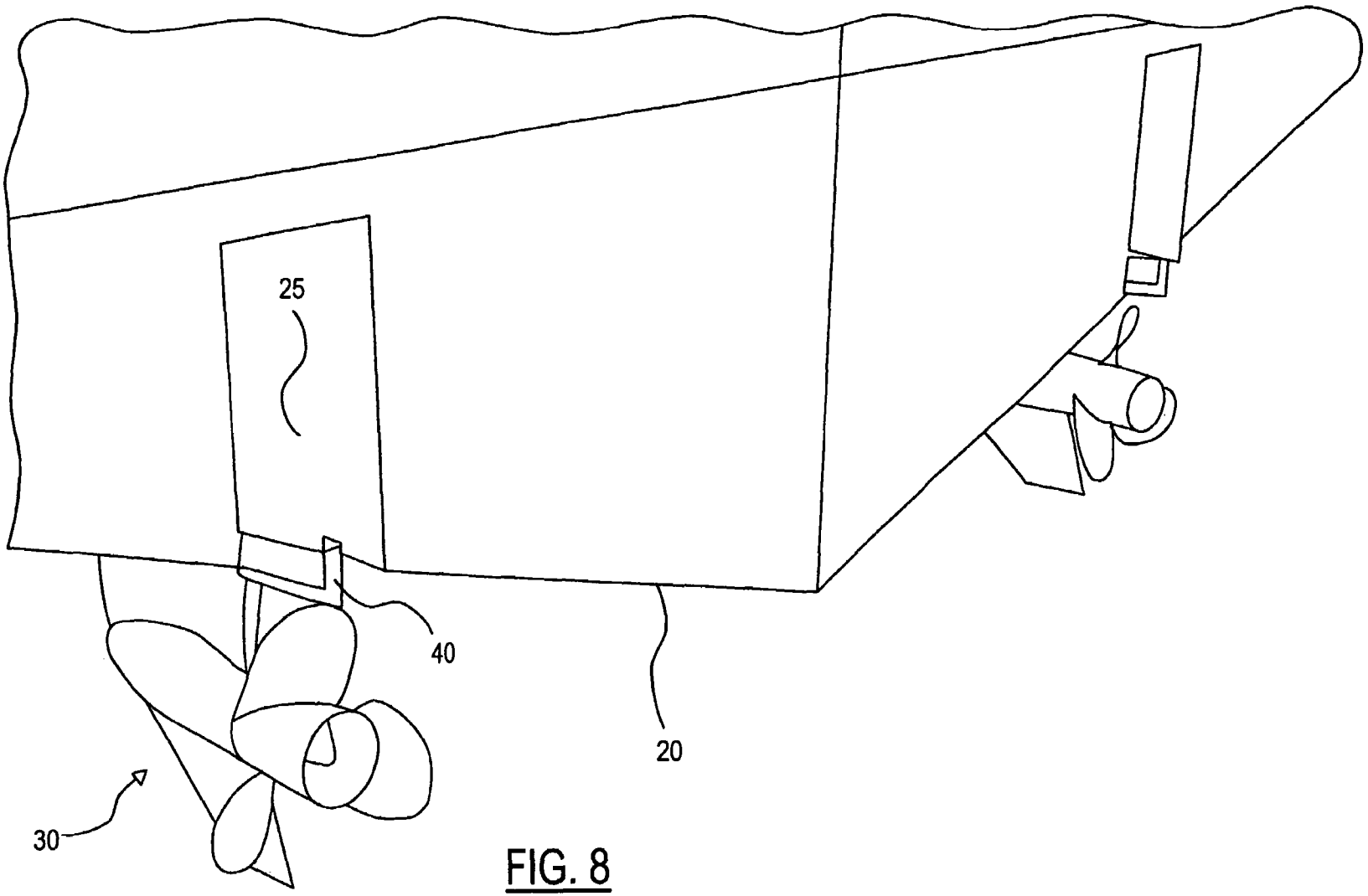
Figure 9:
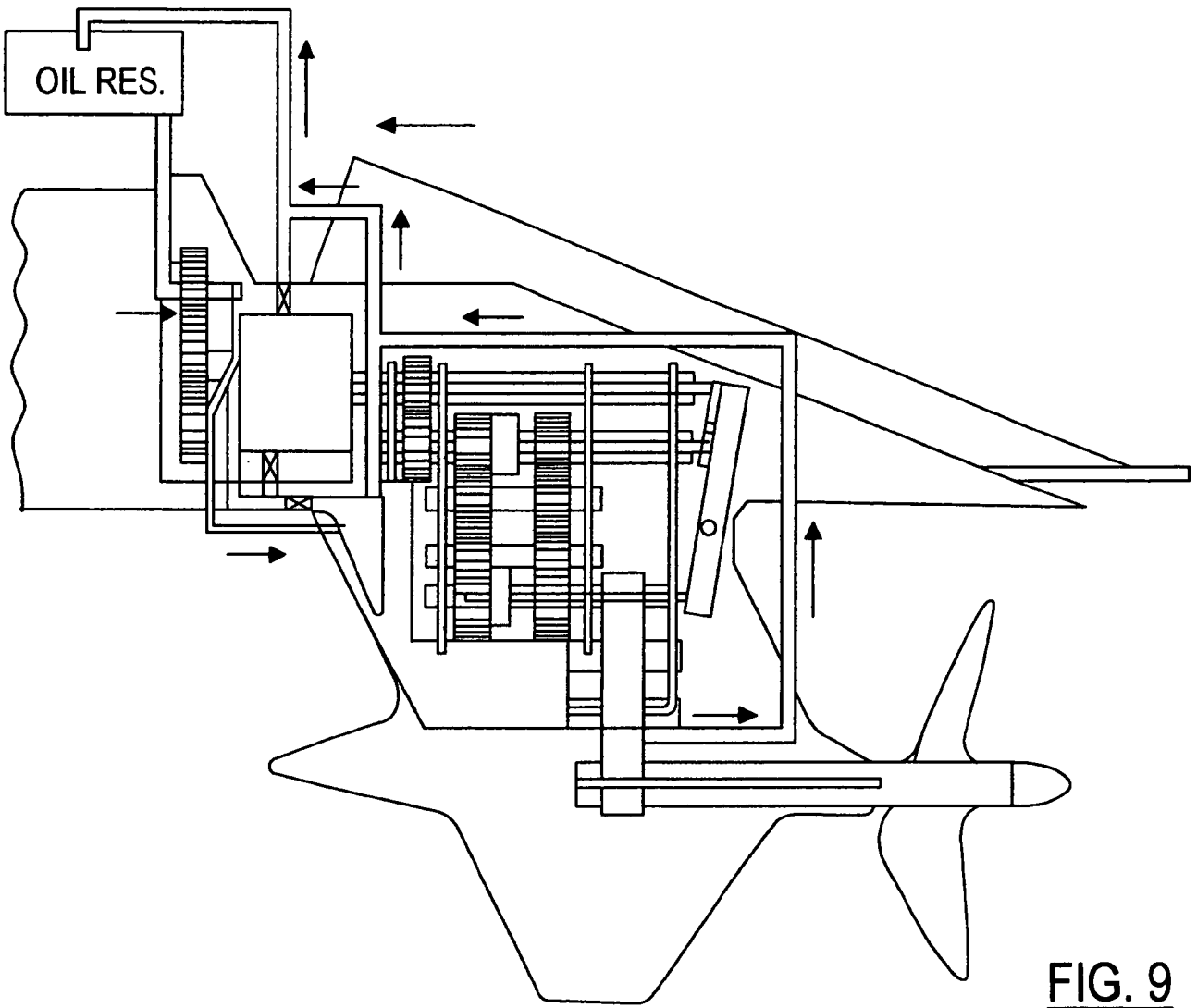
Figure 10:
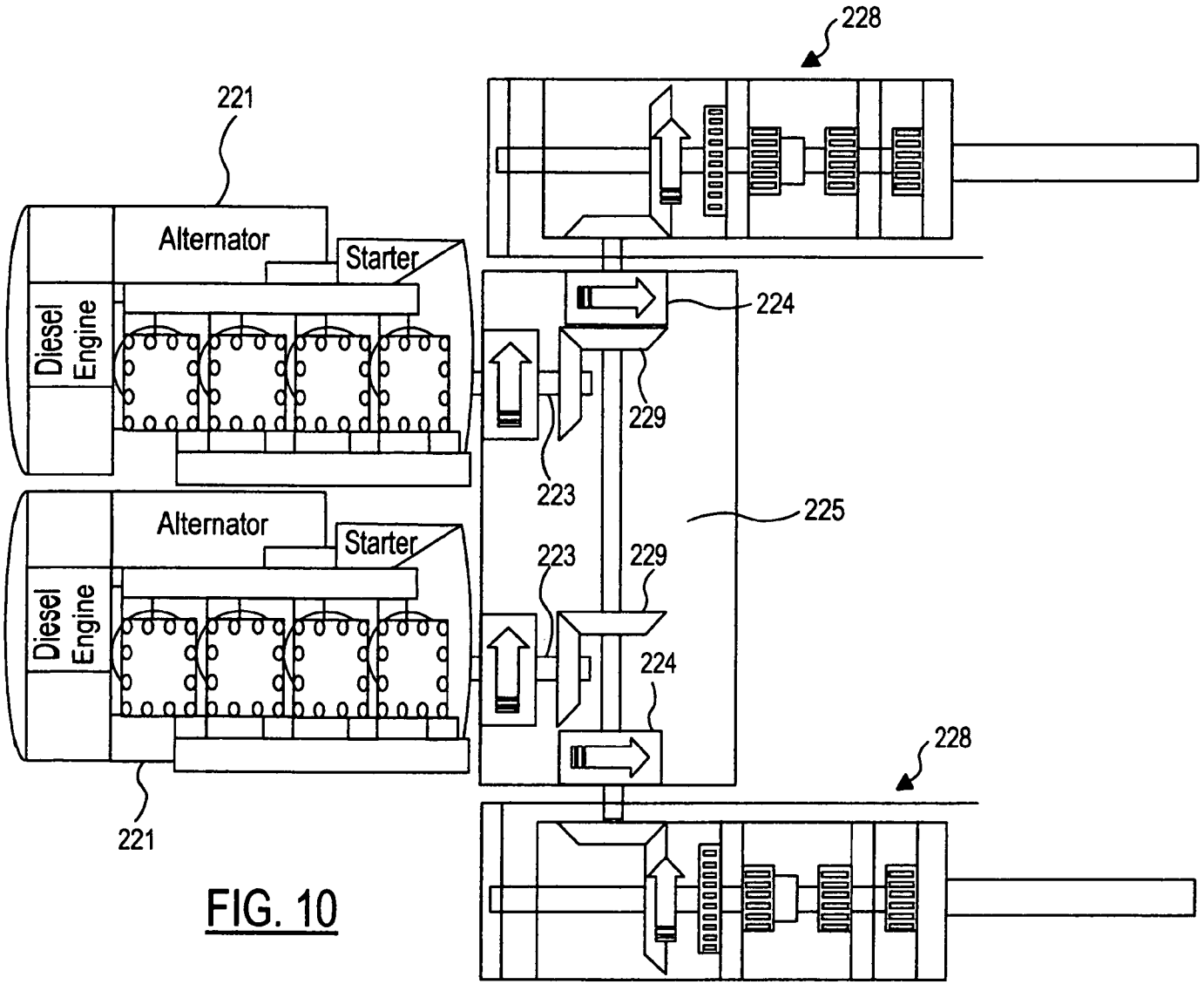
Figure 11:
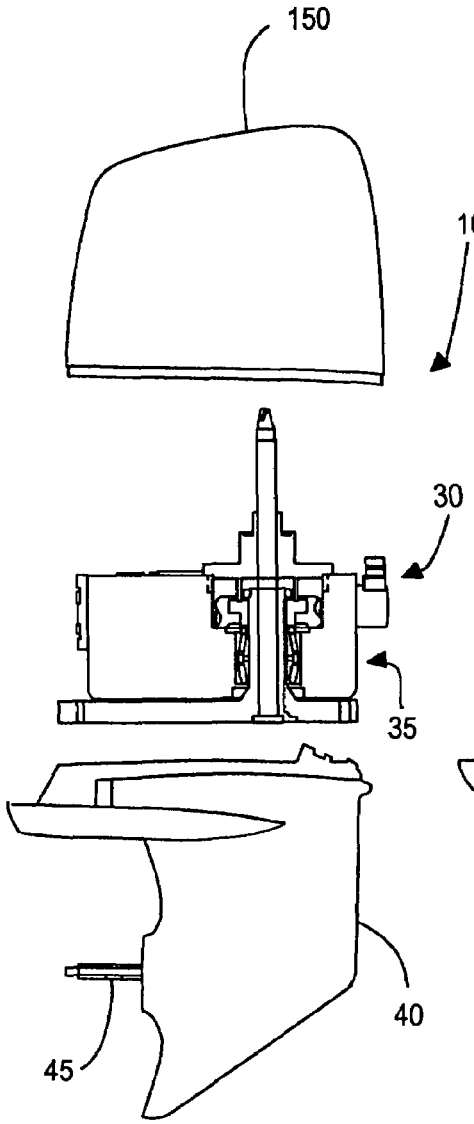
Figure 12:
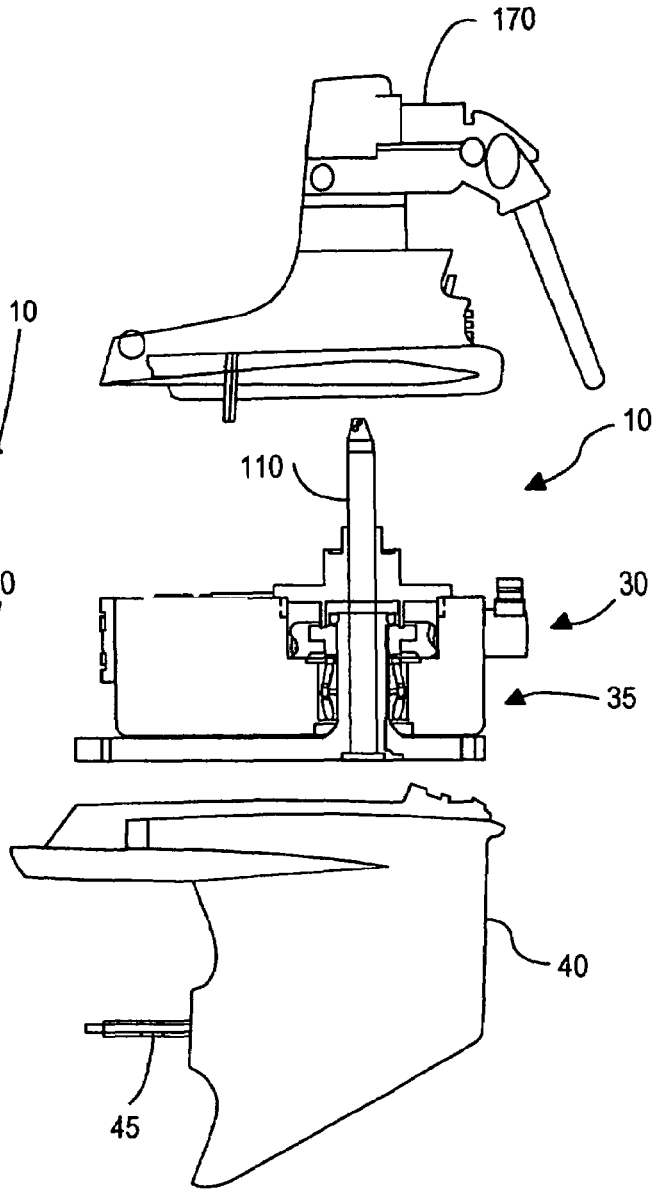

FIG. 1 is a perspective view of the marine drive system of the present invention;

FIG. 2 is a perspective view of the marine drive system of the present invention;

FIG. 3 is a perspective view of the marine drive system of the present invention;

FIG. 4 is a sectional view of the marine drive system of the present invention;

FIG. 5 is a top view of the marine drive system of the present invention;

FIG. 6 is a perspective view of the marine drive system of the present invention detailing the trim arc;

FIG. 7 is a side view of the marine drive system of the present invention;

FIG. 8 is a perspective view of a boat hull including a cavity and a transom having a notch and a drive assembly disposed within the cavity;

FIG. 9 is side view of a drive assembly having a parallel shaft configuration;

FIG. 10 is a depiction of a twin diesel engine version of the drive system of the present invention;

FIG. 11 is a perspective view of the marine drive system of the present invention having an outboard engine;

FIG. 12 is a perspective view of the marine drive system of the present invention having an outdrive engine;

DETAILED DESCRIPTION OF THE INVENTION

The marine propulsion system 10 of the present invention may utilize an all-parallel shaft design similar to that of U.S. Pat. No. 6,902,448 which is herein incorporated by reference. The all-parallel design, as disclosed in the above referenced patent, and as shown in FIG. 9 may include an input shaft that is connected to a drive shaft of the engine by a pair of reduction gears. The main drive shaft extends from the reduction gears to the clutch (hydraulic or other) and then to a drive gear for a second reduction. The input shaft is hollow to receive a shift rod which extends through the drive shaft to a lever arm which is connected to rods connected to clutch dogs on two intermediate shafts. The shift rod is formed in segments which are connected with ball bearings and races formed on the ends of the rod to permit relative rotation between the shift rods and the lever arm. The two intermediate shafts are mounted in parallel arrangement between the main input shaft and the propeller shaft. They are connected together by vertical aligned sets of gears. One set of gears provides a forward drive and has four gears in a vertical arrangement. The set of reverse gears has five gears, including a reverse gear that is offset on a shaft just beneath the first intermediate shaft. The vertical sets of gears are used to provide a very thin side-to-side profile for the foil portion of the housing. Thus, power is transferred downwardly without using large diameter gears. Movement of a shift cam at one end of the main drive shaft engages the hydraulic clutch to drive the main drive shaft and the second driven gears. At the same time, the lever arms are moved to move the clutch dogs on the two intermediate shafts to engage one of the two sets of gears corresponding to either forward or reverse direction. These gears then in turn drive the second drive shaft to turn a final set of gears that extends downwardly to connect with the gear mounted on the propeller shaft.

Additionally, the marine drive system 10 of the present invention may use a vertical shaft/bevel gear design. The marine drive system 10 can be configured for pusher, puller, and twin-propeller counter-rotating drive designs. The determination of when to employ the different shaft and gearing design options described above and below is specific to the intended vessel's size, operational weight, propulsive power requirements and intended performance.

The all-parallel shaft option will provide the strength necessary to address any vessel's needs while maintaining a simple, robust, hydrodynamically efficient profile throughout. The vertical shaft/bevel gear elements can provide similar strength and has the ability to adapt to a steerable drive configuration, as will be discussed in more detail below. The vertical shaft/bevel gear elements may be utilized for high horsepower applications with the vertical shaft/bevel gear portion of the drive located such that it does not become a high-drag appendage and an unacceptable penalty to a vessel's overall hydrodynamic efficiency and performance.

The vertical shaft/bevel gear drive designs may be utilized by the present invention with horsepower ratings less than the all-parallel design. The all-vertical shaft/bevel gear designs are capable of accommodating typical small-to-medium vessel horsepower requirements.

Referring to FIGS. 1 and 8, the marine propulsion system 10 of the present invention includes a vessel hull 15 having a transom 20 formed at the aft portion of the hull 15. The vessel hull 15 includes a cavity 25 formed therein forward of the transom. A drive assembly 30 includes upper 35 and lower unit 40. The upper unit 35 of the drive assembly 30 is pivotally mounted within the hull-cavity 25 for adjusting a pitch of the drive assembly 30 about a horizontal axis. The lower unit 40 of the drive assembly 30 is attached to the upper unit 35 of the drive assembly 30 and includes a propulsory member 45 for driving the vessel hull 15.

The drive assembly 30 of the present invention may be mounted external of the vessel hull 15 within a watertight, solid structure hull-cavity 25 that is completely sealed off from all compartments internal to the vessel hull 15, such as an engine room which houses the engine used in the marine drive system 10 of the present invention. The only penetration required through the watertight hull-cavity 15 is for trunnion hubs 50 and hydraulic/electrical/fiber-optic lines/cables required to service the electro-hydraulic control activated hydraulic cylinder(s) and hydraulic motors and sensors responsible for the drive pitch actuation, steering actuation and drive position indication, as will be discussed in more detail below.

Two trunnion hubs 50 are required per drive assembly 30, one on each side of the drive's upper unit 35 gearbox 56. Mounting configuration options include either one solid trunnion hub 50 and one hollow center cavity trunnion hub 65 to allow for the passage of one driveshaft 65, or two hollow center cavity trunnion hubs 50 to allow for the passage of two driveshafts 65, one per side of the drive assembly 30. Drive assemblies 30 can be coupled to one or two driveshafts 65 depending on the marine drive system 10 design and configuration. The driveshafts 65 engage the drive assembly 30 by entering through the hollow center cavity 70 of a trunnion hub 50. The drive's upper unit 35 gearbox 56 is designed to accept only 1 driveshaft 65 per hollow center cavity 70 trunnion 50, or in other words, a maximum of one driveshaft 65 per side of a drive assembly 30. The drive assembly 30 may be driven from either side or simultaneously through both sides.

The hull-cavity is by design exposed to the elements and expected to fill with water while the vessel is idle or underway at low speeds. A tapered turret may be incorporated to improve the marine drive system's 10 hydrodynamic efficiency. The turret is used to shield the larger profile of the drive assembly's 30 upper unit 35 from potentially becoming a high drag concern. The upper unit 35 of the drive assembly 30 houses larger drive components, such as the steering assembly and accommodates external mounting of the steering system's hydraulic motor 135. The turret can also prevent water from rushing into the drive system's hull-cavity 25. The turret straddles the drive assembly 30 as a close-tolerance housing attached to the upper unit 35 of the drive assembly 30 to maintain a smooth flow of water at medium and high-speeds and isolating the upper unit 35 of the drive assembly 30 from the hull-cavity 25.

Placement of the drive assembly 30 on any vessel is a critical design decision with tremendous influence on a vessel's overall performance. Unique to the drive assembly 30 of the present invention is the need to account for its pitch arc within the placement decision. It is highly inefficient if during normal intended operation, the arc created by articulating the drive assembly 30 places the thrust vector either within the hull-cavity 25 or against the vessel hull 15. If not in conflict with other engineering requirements, designers have several options in the placement of a drive assembly 30. First, one may move the drive assembly 30 further aft so the generated thrust vectors are not obstructed, including having the up-pitch or "up-trim" arc, when at the extreme of its travel, extends beyond the transom 20. Second, one may open, by notching or tunneling the aft hull-cavity 25 area and transom 20 to the extent necessary for eliminating thrust vector restriction, as shown in FIG. 8. In such a design, a truss or similar load bearing structure can be used to provide strength by spanning atop the open transom 20 areas. Third, one may limit the up-pitch or "up-trim" angle such that the thrust vector may never be adversely affected by the vessel hull 15 or hull-cavity 25.

As shown in FIGS. 1-7, the trunnion hubs 50 and corresponding trunnion bosses 52, formed in the hull-cavity 25, provide for long-term strength and limited friction/wear operation while pivoting. It should be realized that alternative structural members providing for the pivoting of the drive assembly 30 relative to the hull-cavity 25 may be used by the present invention. The trunnion hubs 50 perform many functions in the marine propulsion system 10 of the present invention. The trunnion hubs 50 serve as the mounting structure for the drive assembly 30 and center the drive assembly 30 within its hull-cavity 25. The trunnion hubs 50 allow the drive assembly 30 to pivot relative to the hull-cavity 25, allowing both positive and negative pitch articulation of the drive assembly 30. The trunnion hubs 50 house the driveshaft or shafts 70 depending on the number of engines which mechanically links the drive assembly 30 either directly to the engines or to combining gearbox if they are utilized. The trunnion hubs 50 allow for sealing the hull-cavity from the engine room and/or other compartments internal to the hull.

The trunnion hubs 50 are hard-mounted to the drive's upper unit 35 with the corresponding trunnion bosses 52 hard-mounted to the hull-cavity 25. The trunnion hubs 50 rotate within the trunnion bosses 52 through sealed bearings or other sealable friction/wear reducing mechanisms, such as bushings that may be inserted between the trunnion hubs 50 and the trunnion bosses 52.

The pitch or "trim" characteristics of the marine drive system 10 relative to thrust vector angle is heavily influenced by several factors including: 1) the location of the drive assembly's 30 pivot point and its proximity to the prop or other propulsion member 45, and 2) the propulsion member's 45 water depth at neutral drive "trim". A shorter horizontal distance between the pivot point and the propulsion member 45 requires a deeper neutral thrust vector position. This configuration is more attractive to applications desiring increased pitch authority because of the drive's more even distribution between "under-trim" and "up-trim". Increasing the horizontal distance between the pivot point and the propulsion member 45 requires a shallower neutral thrust vector position. This configuration is more attractive to high performance vessel applications desiring the thrust vector be optimized for speed which would place it near parallel to the surface of the water with an emphasis on raising as much of the drive assembly 30 out of the water as possible to reduce drag.

Referring to FIG. 6, the marine drive system 10 of the present invention is positive-pitch and negative-pitch articulated by a pitch actuator 90, such as an electro-hydraulic control activated hydraulic cylinder 92, however, the pitch actuator 90 may be any suitable mechanism capable of pivoting the drive assembly 30 such as a ball-screw actuator, capable of supporting drive assembly 30 thrust vector angle changes in the magnitude of 50 to 60 degrees per second. The electro-hydraulic control activated hydraulic cylinders 92 respond to precise positioning instructions received from a vessel control system. The pitch control hydraulic cylinders 92 may include either mechanical or electrical pumps that can be used to generate and sustain the hydraulic pressure necessary for articulating the drive assembly 30. In the case of a single-actuator pitch control configuration, the ideal mounting position for the pitch control hydraulic cylinder 92 is forward of the drive assembly 30 toward the vessel's bow at approximately a 45-degree angle relative to the drive assembly 30 when the drive assembly 30 is neutral, in a static, zero-pitch position, referenced against zero-degrees at the top of the drive assembly 30, or its 12 o'clock position. This position of the hydraulic cylinder 92 will permit rapid vertical adjustment of the thrust vector angle with sufficient "under-trim" (also referred to as "in-trim" or "down-trim") without possibly interfering or limiting the drive's "up-trim" (also referred to as "out-trim") travel which in the case of a surface-piercing mode can be a very aggressive pitch angle depending on the drive assembly's 30 specific design and pivot point. Forward mounting the pitch control hydraulic cylinder 92 also gives naval architects the freedom to leave the transom 20 open, notched or tunneled aft of the drive's hull-cavity 25. The open transom 20 will allow for higher performance vessel designs where a configuration of the drive assembly 30 is optimized for a surface piercing mode. The hydraulic cylinder's 92 push-pull rod 94 is coupled to the drive assembly 30 in such a way as to provide both strength and the necessary freedom of motion required to achieve the degree of pitch control intended by the vessel's design team.

As shown in FIGS. 1 and 6, in one aspect of the present invention, a trunnion bracket 95 is attached to the upper unit 35 of the drive assembly 30 for securing the hydraulic cylinder's push-pull rod 94 to the drive assembly 30. The base of the hydraulic cylinder 92 will be securely mounted to the previously described hull-cavity 25 attachment point. The location of the trunnion bracket 95 assembly on the drive assembly 30 is a critical decision intended to be a balance between minimizing the hydraulic cylinder's control rod 94 length/run-out/travel while at the same time maximizing the pitch control hydraulic cylinder's 92 leverage advantage during articulation of the drive assembly 30. The length/run-out/travel of the hydraulic cylinder's control rod 94 is such that the drive assembly's 30 propulsion member 45 may be moved forward and aft a sufficient distance to permit the thrust vector to change as much as is necessary to meet a vessel's design and performance objectives. The thrust vectors created by the propulsion members 45, such as propellers, impellers, jet nozzles can be manipulated rapidly by a vessel control system to stabilize any vessel.

As shown in FIGS. 1-7, the marine drive system 10 may be steerable, as well as pitch articulated. Power is transferred from the main horizontal input shaft 70 centered within the trunnion hub 50, to the main drive assembly shaft 100 centered vertically down through both the upper and lower units 35, 40. The main drive assembly shaft 100 may be linked to a horizontal propeller shaft 105 located in the lower unit 40 of the drive assembly 30. Right-angle transfer is accomplished with bevel gears. A hollow steering spindle 110 is suspended within the upper unit 35 of the drive assembly 30 by an upper and a lower bearing set. The steering spindle 110 is bolted securely to the lower unit 40 of the drive assembly 30. The steering spindle 110 includes a gear 115 coupled to the spindle 110. The gear 115 is in meshing contact with a worm gear assembly 120 to rotate the spindle 110 and the lower unit 40 of the drive assembly 30. As stated above, the lower unit 40 of the drive assembly 30 is rotatable through 360 degrees. The worm gear assembly 120 is coupled to the steering spindle 110 on the peripheral circumference of the gear 115. The worm gear assembly 120 is mounted within a boss 130 provided on the upper unit 35 of the drive assembly 30. A hydraulic motor 135 mounted to the upper unit 35 of the drive assembly 30 turns the worm gear assembly 120, which in turn rotates only the lower unit 40 of the drive assembly 30. It should be realized that alternative gear actuation assemblies and powering mechanisms may be used by the present invention. The worm gear assembly 120, with hydraulic motor 135 actuation, permits rotation of the lower unit 40 of the drive assembly 30 independently of the movement of the vertical driveshaft 100 driven by the vessel's engines providing a steerable, pitch articulating drive assembly 30.

In one aspect of the present invention, the drive assemblies 30 may include a torque dampening capability to reduce the influence of power pulses on the drive assembly. A set of non limiting examples include, harmonic balancers, torque converters, hydraulic and pneumatic dampeners, flywheels, clutch packs, and other torque dampening mechanisms. It should be realized that other torque dampening mechanisms not outlined above may be used by the invention. These torque dampening mechanisms can be resident to the drive assembly 30, the engine and, depending on a specific vessel's propulsion system configuration, a combining gearbox and/or a transmission. Tremendous latitude exists with respect to the torque dampening solution within the overall drive system 10 design.

The novel marine drive system 10 of the present invention is well suited for integration with all known engine/motor/powerplant technologies to include gas turbine engines, steam turbine engines, conventional internal combustion gasoline engines, diesel engines, fuel cell powered electrical motors, etc. The described marine drive system 10 integrates easily with one or more powerplants of equal or dissimilar type and power/torque generating capacity. The described marine drive system 10 can be driven directly by one or more powerplants and indirectly by one or more powerplants through one or more combining gearboxes and or transmissions.

Referring to FIG. 10, there is shown an example of a twin-diesel engine configured drive application. Each engine 221 is connected to a transmission/combining gearbox assembly 225 and a pair of pitch articulating propulsion assemblies 228. The propulsion assemblies 228 pivot at the centerline of the input shaft of the meshed bevel gears thereby eliminating universal joints or the like. As shown, there is a pair of diesel engines 221 having drive shafts 223 extending into a transmission assembly. The transmission assembly has clutch assemblies 224 from which shafts with bevel gears extending axially from the engines have gears 229 enmeshed with bevel gears mounted on a transverse shaft 211.

In one aspect of the present invention, the drive assembly 30 may be configured in an open transom 20 or elongated hull-cavity 25 can be parked in a horizontal or near horizontal position for obstacle avoidance during shallow water operation or to accommodate out of water transportation and hoisting, etc.

The drive assembly 30, in conjunction with a depth finder or obstacle avoidance technology can be raised automatically, overriding operator settings, when vessel sensors identify a clearance concern, especially in shallow water environments. For higher-speed operations, logic can be incorporated in the vessel control system to identify slope changes in underwater landmasses and predict probable drive strike based on the relationship between speed, slope and drive depth.

The drive assembly 30 components of the present invention can be adapted to existing marine outboards, improving their overall performance and capability. Wherein the outboard's powerhead (motor) 150 replaces the right angle drive gearbox 56 portion of the upper unit 35 and is rotatably coupled to the lower unit 40. The lower unit 40, independent of the outboard powerhead 150, can be rotated less than, equal to or greater than 360 degrees about a horizontal axis. The lower unit 40 includes a propulsory member 45 for propelling the vessel through a body of water. The independent rotation of the lower unit 40 changes the thrust vector of the propulsory member 45 about a vertical axis which in turn is used to steer a vessel. As stated above, marine drive assembly 10 includes a steering spindle 110 suspended within the outboard powerhead 150 and having a gear 115 coupled to the steering spindle 110 with the steering spindle 110 attached to the lower unit 40 of the drive assembly 30. Similar to the embodiment described above, a worm gear assembly 120 is mounted to the outboard powerhead 150 assembly. The worm gear assembly 120 includes a worn gear in meshing contact with the gear 115 of the steering spindle 110 for rotating the lower unit 40 about the vertical axis. Except for optional elimination of the outboard's conventional steering assembly and a requirement to install a hydraulic pump on the powerhead 150, mounting and operation of the outboard drive assembly 30 is identical to all current methods of outboard integration. The installation options include applying the 360 degree steering capability part time for highly precise maneuverability at low speeds which will require maintaining the original outboard steering means, or applying the 360 degree steering fill time which would result in abandoning the original outboard steering means. The powerhead 150 may include art integrated hydraulic pump, providing the hydraulic pressure necessary for operating the worm gear assembly 120.

The drive assembly 30 components of the present invention can be adapted to existing marine outdrives, improving their overall performance and capability. Wherein the outdrive's upper drive assembly 170 replaces the right angle drive gearbox 56 portion of the upper unit 35 and is rotatably coupled the lower unit 40. The lower unit 40, independent of the outdrive's upper drive assembly 170, can be rotated less than, equal to or greater than 360 degrees about a vertical axis. The lower unit 40 includes a propulsory member 45 for propelling the vessel through a body of water. The independent rotation of the lower unit 40 changes the thrust vector of the propulsory member 45 about a vertical axis which in turn is used to steer a vessel. Additionally, a steering spindle 110 suspended within the outdrive's upper drive assembly 150 includes a gear 115 coupled to the steering spindle 110 with the steering spindle 110 attached to the lower unit 40. As described above, the drive assembly 30 includes a worm gear assembly 120 mounted to the outdrive's upper drive assembly 170. The worm gear assembly 120 includes a worm gear in meshing contact with the gear 115 of the steering spindle 110 for rotating the lower unit 40 of the drive assembly 30 about the vertical axis. Except for optional elimination of the outdrive's conventional steering assembly and a requirement to install a hydraulic pump on the inboard motor, mounting and operation of the outdrive assembly 170 is identical to all current methods of outdrive integration. The installation options include applying the 360 degree steering capability part time for highly precise maneuverability at low speeds which will require maintaining the original outdrive's steering means, or applying the 360 degree steering full time which would result in abandoning the original outdrive's steering means. The inboard motor may include an integrated hydraulic pump, providing the hydraulic pressure necessary for operating the worm drive.

The invention has been described in an illustrative manner. It is to be understood that the terminology which has been used is intended to be in the nature of words of description rather than limitation. Many modifications and variations of the invention are possible in light of the above teachings. Therefore, within the scope of the appended claims, the invention may be practiced other than as specifically described.

The invention claimed is:

1. A marine drive assembly comprising:

at least one vessel hull having at least one cavity formed therein, the cavity including trunnion bosses formed therein;

at least one drive assembly disposed in the at least one cavity formed in the vessel hull, the at least one drive assembly including upper and lower units;

the upper unit, including trunnion hubs formed on the upper unit of the drive assembly and received in the trunnion bosses for pivotally mounting the drive assembly with respect to the hull for adjusting a pitch of the drive assembly about a horizontal axis, wherein at least one of the trunnion hubs includes a hollow center cavity allowing passage of a drive shaft from an engine or gearbox to the drive assembly;

the lower unit coupled to the upper unit, the lower unit including a propulsory member for propelling the vessel through a body of water.

2. The marine drive assembly of claim 1 wherein the upper unit is rotatably coupled to the lower unit and wherein the lower unit can be independently rotated relative to the upper unit about a vertical axis changing the thrust vector of the propulsory member about the vertical axis.

3. The marine drive assembly of claim 1 wherein two of the trunnion hubs include a hollow center cavity allowing passage of two drive shafts, one per hollow center cavity from two independent engines or gearboxes to the drive assembly.

4. The marine drive assembly of claim 1 including a pitch actuator attached to the drive assembly at a first end and to the cavity at another end for adjusting the pitch of the drive assembly about a horizontal axis.

5. The marine drive assembly of claim 4 wherein the pitch actuator is attached to a trunnion bracket formed on the drive assembly at the first end of the actuator and to the hull-cavity at the other end of the actuator.

6. The marine drive assembly of claim 5 wherein the trunnion bracket is positioned on the drive assembly such that the pitch actuator may adjust the pitch of the drive assembly about the horizontal axis.

7. The marine drive assembly of claim 4 wherein the pitch actuator is a hydraulic cylinder.

8. The marine drive assembly of claim 4 wherein the pitch actuator is attached to the drive assembly forward of the drive assembly at approximately a 45 degree angle relative to the drive assembly when the drive assembly is in a neutral zero pitch position.

9. The marine drive assembly of claim 7 wherein the length/run-out/travel of a pitch actuator's control rod is such that the drive assembly's propulsion member may be moved forward and aft a sufficient distance to permit a designed thrust vector change.

10. The marine drive assembly of claim 1 wherein the at least one cavity formed in the at least one hull can be positioned anywhere in the hull, and including a forward-adjacent to a transom position and an aft-adjacent to the transom position for adaptation to outboard engines and outdrives.

11. The marine drive assembly of claim 1 wherein the at least one cavity formed in the at least one hull includes an open transom forming a notch or tunnel allowing the propulsory member to swing clear of the vessel while at an extreme of its up-pitch or up-trim arc.

12. The marine drive assembly of claim 1 wherein the at least one cavity formed in the at least one vessel hull is sealed with respect to other compartments internal to the vessel hull.

13. The marine drive assembly of claim 1 wherein a turret is attached to the upper unit of the drive assembly isolating it from an exposed bottom of the cavity improving a hydrodynamic efficiency of the drive assembly.

14. The marine drive assembly of claim 2 including a steering spindle suspended within the upper unit of the drive assembly and having a gear coupled to the steering spindle, the steering spindle attached to the lower unit of the drive assembly.

15. The marine drive assembly of claim 14 including a worm drive mounted to the upper drive assembly, the worm drive including a worm gear in meshing contact with the gear of the steering spindle for rotating the lower unit of the drive assembly about the vertical axis.

16. The marine drive assembly of claim 10, wherein the at least one cavity formed in the at least one hull includes an open transom forming a notch or tunnel and wherein the drive assembly is movable to a near horizontal position for obstacle avoidance during shallow water operation and accommodating out of water transportation.

17. The marine drive assembly of claim 10, wherein the at least one hull cavity extends beyond a transom and wherein the drive assembly is movable to a near horizontal position for obstacle avoidance during shallow water operation and accommodating out of water transportation.

18. The marine drive assembly of claim 17 including an obstacle avoidance device associated with the drive assembly for automatically overriding operator settings raising the drive assembly to a near horizontal position in response to a detected obstacle.

* * * * *

UNITED STATES PATENT AND TRADEMARK OFFICE

CERTIFICATE OF CORRECTION

PATENT NO. : 7,485,018 B2
APPLICATION NO. : 11/405204
DATED : February 3, 2009
INVENTOR(S) : Jim Wilson et al.

It is certified that error appears in the above-identified patent and that said Letters Patent is hereby corrected as shown below:

Column 7, Line 53 - remove "worn" and insert --worm--

Column 7, Line 64 - remove "fill" and insert --full--

Column 7, Line 65 - remove "art" and insert --an--

Signed and Sealed this

Twenty-seventh Day of October, 2009

David J. Kappos

David J. Kappos
*Director of the United States Patent and Trademark Office*